US009486658B2

(12) United States Patent
Alexander

(10) Patent No.: US 9,486,658 B2
(45) **Date of Patent: *Nov. 8, 2016**

(54) EDGE FITTINGS FOR SOFT-EDGED TRAMPOLINE

(75) Inventor: Keith Vivian Alexander, Christchurch (NZ)

(73) Assignee: Board & Batten International Inc., Georgetown (KY)

( * ) Notice: Subject to any disclaimer, the term of this patent is extended or adjusted under 35 U.S.C. 154(b) by 264 days.

This patent is subject to a terminal disclaimer.

(21) Appl. No.: 13/344,732

(22) Filed: Jan. 6, 2012

(65) Prior Publication Data

US 2012/0100962 A1 Apr. 26, 2012

Related U.S. Application Data

(63) Continuation of application No. 12/406,572, filed on Mar. 18, 2009, now Pat. No. 8,105,211, which is a continuation of application No. 10/496,178, filed as application No. PCT/NZ02/00255 on Nov. 20, 2002, now abandoned.

(30) Foreign Application Priority Data

Nov. 20, 2001 (NZ) ..... 513331

(51) Int. Cl.
*A63B 5/11* (2006.01)
*A63B 21/02* (2006.01)

(52) U.S. Cl.
CPC ..... *A63B 5/11* (2013.01); *A63B 21/026* (2013.01)

(58) Field of Classification Search
CPC ..... A63B 5/11; A63B 21/026; A63B 5/08; A63B 21/045
USPC ..... 482/14, 15, 23, 26, 27
See application file for complete search history.

(56) References Cited

U.S. PATENT DOCUMENTS

| | | | | |
|---|---|---|---|---|
| 503,572 | A | 8/1893 | Beal | |
| 952,871 | A * | 3/1910 | Browder | 182/139 |
| 1,018,698 | A | 2/1912 | Dennis | |
| 1,064,968 | A | 6/1913 | Hagen | |
| 1,099,352 | A | 6/1914 | Foldi | |
| 1,374,333 | A | 4/1921 | Stotler et al. | |
| 1,509,750 | A | 9/1924 | Cambell | |

(Continued)

FOREIGN PATENT DOCUMENTS

| | | |
|---|---|---|
| CN | 2195352(Y) | 4/1995 |
| CN | 2278499(Y) | 4/1998 |

(Continued)

OTHER PUBLICATIONS

A Sinha et al., "Study of aeroball injuries," Br J Sports Med, 31:200-204, May 14, 1997, 5 pages.

(Continued)

*Primary Examiner* — Sundhara Ganesan
(74) *Attorney, Agent, or Firm* — Fish & Richardson P.C.

(57) ABSTRACT

A soft edged trampoline includes a flexible mat supported from a base frame by a plurality of resiliently flexible rods. Each rod has an enlarged upper end. A plurality of fittings coupled to the mat about the periphery of the mat each include a socket cavity which receives the enlarged upper end of a flexible rod, so that the upper ends of the flexible rods are pivotally connected to the periphery of the mat.

21 Claims, 6 Drawing Sheets

(56) References Cited

U.S. PATENT DOCUMENTS 1,570,526 A 1/1926 Robinson
1,579,184 A 3/1926 Weiland
1,587,749 A 6/1926 Bierly
1,630,459 A 5/1927 Zeidler
1,638,350 A 8/1927 Long
1,654,079 A 12/1927 Hiering
1,666,111 A 4/1928 Sussin
1,702,941 A 2/1929 Hardy
1,703,666 A 2/1929 Goetz
1,738,411 A 12/1929 Welch
1,774,672 A 9/1930 Rush
1,922,466 A 8/1933 Yoes
1,935,537 A 11/1933 Balduf
2,025,263 A 12/1935 Arner
2,037,215 A 4/1936 Andrea
2,056,957 A 10/1936 Colbridge
2,112,315 A 3/1938 Townsend
2,115,400 A 4/1938 Schlappritzi et al.
2,277,853 A 3/1942 Kohn
2,317,057 A 4/1943 Higby
2,313,171 A 5/1943 Piliero
2,324,970 A 7/1943 Woolley
2,358,426 A 9/1944 Tompson
2,376,776 A 5/1945 Jones et al.
2,406,746 A 9/1946 Davis
2,730,412 A 1/1956 Yoder
2,764,766 A 10/1956 Boyle et al.
2,797,853 A 7/1957 James
2,812,180 A 11/1957 Cymbal
3,079,139 A 2/1963 Greene et al.
3,095,947 A * 7/1963 Beaulaurier ..... 482/27
3,104,875 A 9/1963 Doyle
3,129,740 A 4/1964 Nourse et al.
3,201,126 A 8/1965 Nissen
3,347,546 A 10/1967 Abberly
3,356,367 A 12/1967 Tewksbury
3,371,928 A 3/1968 Buddo
3,402,924 A 9/1968 Rix
3,417,984 A 12/1968 Sindlinger
3,490,758 A 1/1970 Foster
3,561,564 A 2/1971 Russell
3,616,126 A 10/1971 Tungseth et al.
3,634,895 A 1/1972 Childers
3,641,601 A 2/1972 Sieg
3,650,520 A 3/1972 Vernon et al.
3,671,997 A 6/1972 Sigmund
3,677,368 A 7/1972 Green
3,709,197 A 1/1973 Moseley
3,734,496 A 5/1973 Rubin
3,782,724 A 1/1974 Rottman et al.
3,850,264 A 11/1974 Salinas
3,879,025 A 4/1975 Dillard
3,891,208 A 6/1975 Sidlinger
3,895,835 A 7/1975 Thomson
3,968,964 A 7/1976 Grosser et al.
3,974,532 A 8/1976 Ecchuya
4,015,760 A 4/1977 Bott
4,018,438 A 4/1977 Shoger
4,037,834 A 7/1977 Oaks
4,056,265 A 11/1977 Ide
4,196,903 A 4/1980 Illustrato
4,198,044 A 4/1980 Holappa
4,199,136 A 4/1980 Mansfield
4,218,599 A 8/1980 Garn
4,279,415 A 7/1981 Katz
4,316,297 A 2/1982 Geist
4,323,231 A 4/1982 Wilson
4,339,123 A 7/1982 Rich
4,341,379 A 7/1982 Milligan
4,341,380 A 7/1982 Sauder
4,344,616 A 8/1982 Ogden
4,350,336 A 9/1982 Hanford
4,386,772 A 6/1983 Wu
4,423,864 A 1/1984 Wiik
4,460,170 A 7/1984 Lundberg et al.
4,483,531 A * 11/1984 Laseman et al. ..... 482/27
4,492,374 A 1/1985 Lekhtman et al.
4,516,767 A 5/1985 Eskijian
4,534,124 A 8/1985 Schnell
4,541,668 A 9/1985 Rouw
4,548,405 A 10/1985 Lee et al.
4,569,515 A 2/1986 Gordon
4,576,375 A 3/1986 Roberts
4,616,822 A 10/1986 Trulaske et al.
4,629,181 A 12/1986 Krive
4,648,592 A 3/1987 Harinishi
4,660,299 A 4/1987 Omilusik
4,667,921 A 5/1987 de Goncourt
4,682,378 A 7/1987 Saveniji
4,713,854 A 12/1987 Graebe
4,730,826 A 3/1988 Sudmeier
4,774,776 A 10/1988 Gulli
4,836,530 A 6/1989 Stanley, Jr.
4,869,479 A 9/1989 Colonel et al.
4,880,226 A 11/1989 Krantz
4,886,266 A 12/1989 Trulaske
4,900,011 A 2/1990 Nolet
4,912,859 A 4/1990 Ritts
4,935,977 A 6/1990 Yamada
4,938,473 A * 7/1990 Lee et al. ..... 482/54
4,974,831 A 12/1990 Dunham
4,984,785 A 1/1991 Wilkinson
4,984,810 A 1/1991 Stearns et al.
5,002,294 A 3/1991 Franz
5,024,485 A 6/1991 Berg et al.
5,029,801 A 7/1991 Dalebout et al.
5,037,084 A 8/1991 Flor
5,072,928 A 12/1991 Stearns et al.
5,074,550 A 12/1991 Sloan
5,087,037 A 2/1992 Morrow
5,096,186 A 3/1992 Wilkinson et al.
5,112,045 A 5/1992 Mason et al.
5,116,045 A 5/1992 Jahoda
5,117,596 A 6/1992 Leslie et al.
5,118,096 A 6/1992 Wilkinson et al.
5,165,125 A 11/1992 Callaway
5,182,824 A 2/1993 Cipriano
5,184,987 A 2/1993 Wilkinson
5,184,988 A 2/1993 Dunham
5,205,798 A 4/1993 Lekhtman
5,209,709 A 5/1993 Eyman, Jr.
5,232,419 A 8/1993 Kozak
5,269,735 A 12/1993 Pfitzenmeier
5,273,510 A 12/1993 Puckett et al.
5,277,675 A 1/1994 Shifferaw
5,279,528 A 1/1994 Dalebout et al.
5,288,127 A 2/1994 Berg et al.
5,290,210 A 3/1994 Hand et al.
5,299,989 A 4/1994 Boyd et al.
5,336,135 A 8/1994 Keyvani
5,336,144 A 8/1994 Rodden
5,382,207 A 1/1995 Skrowronski et al.
5,387,166 A 2/1995 Gvoich
5,399,132 A 3/1995 Bailey
5,405,187 A 4/1995 Soderlund
5,409,200 A 4/1995 Zingher et al.
5,441,468 A 8/1995 Deckers et al.
5,454,772 A 10/1995 Rodden
5,476,530 A 12/1995 Gries et al.
5,484,362 A 1/1996 Skrowronski et al.
5,514,017 A 5/1996 Chimiak
5,562,575 A 10/1996 Gvoich
5,567,009 A 10/1996 Fay et al.
5,577,801 A 11/1996 Glockl
5,588,704 A 12/1996 Harza
5,599,259 A 2/1997 Skrowronski et al.
5,624,122 A 4/1997 Winkelhorn
5,785,303 A 7/1998 Kutschi
5,810,695 A * 9/1998 Sass ..... 482/27
5,813,946 A * 9/1998 Lin et al. ..... 482/27
5,827,155 A 10/1998 Jensen et al.
5,833,557 A 11/1998 Cole
5,913,568 A 6/1999 Brightbill et al.
5,941,798 A 8/1999 Coan et al.

(56) References Cited

U.S. PATENT DOCUMENTS

| | | | | |
|---|---|---|---|---|
| 6,001,045 | A * | 12/1999 | Gift et al. | 482/27 |
| 6,013,011 | A | 1/2000 | Moore et al. | |
| 6,022,303 | A * | 2/2000 | Abdo | 482/140 |
| 6,071,213 | A * | 6/2000 | Raasch et al. | 482/29 |
| 6,095,950 | A | 8/2000 | Katz | |
| 6,258,011 | B1 * | 7/2001 | Wolfe | 482/23 |
| 6,264,583 | B1 | 7/2001 | Rich | |
| 6,319,174 | B1 * | 11/2001 | Alexander | 482/27 |
| 6,361,032 | B1 * | 3/2002 | Lawson | B60G 3/18 267/148 |
| 6,572,513 | B1 | 6/2003 | Whan-Tong et al. | |
| 6,663,538 | B2 | 12/2003 | Yoon | |
| 7,678,024 | B2 * | 3/2010 | Alexander | 482/27 |
| 7,854,687 | B2 | 12/2010 | Alexander | |
| 8,105,211 | B2 * | 1/2012 | Alexander | 482/27 |
| 8,303,469 | B2 | 11/2012 | Alexander | |

FOREIGN PATENT DOCUMENTS

| | | |
|---|---|---|
| DE | 121408 C | 7/1900 |
| DE | 382337(A1) | 10/1923 |
| DE | 4013291(A1) | 10/1991 |
| DE | 19543662 | 5/1997 |
| EP | 0103041(B1) | 3/1986 |
| EP | 0346248 | 5/1989 |
| EP | 0403924(A2) | 12/1990 |
| EP | 0455616(A1) | 11/1991 |
| EP | 0565082 A2) | 10/1993 |
| EP | 1347117(A1) | 9/2003 |
| FR | 2339411 | 8/1977 |
| GB | 190708051 | 0/1907 |
| GB | 2243304(A) | 10/1991 |
| JP | S472245(U) | 8/1972 |

OTHER PUBLICATIONS

American Society for Testing and Materials, "Standard Consumer Safety Performance Specification for Home Playground Equipment," F 1148-88, ASTM, Dec. 1995, 17 pages.

* cited by examiner

FIGURE 6
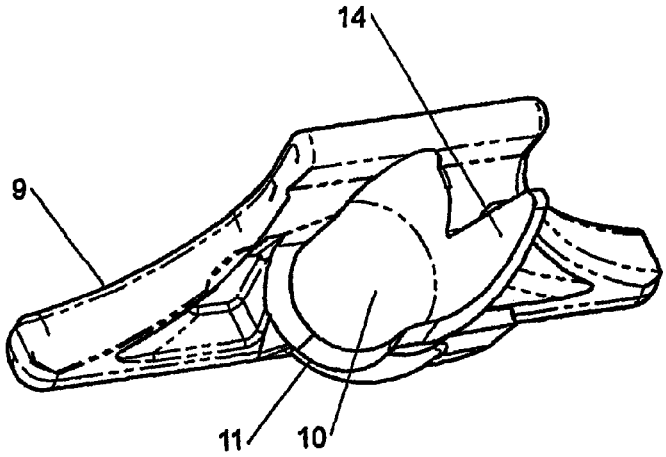
FIGURE 7
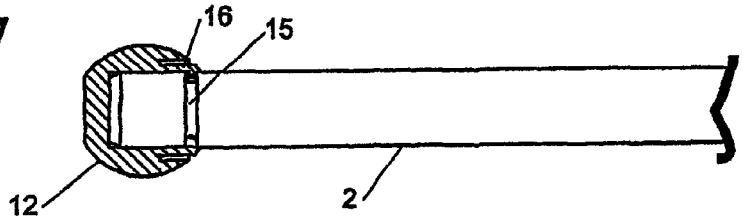
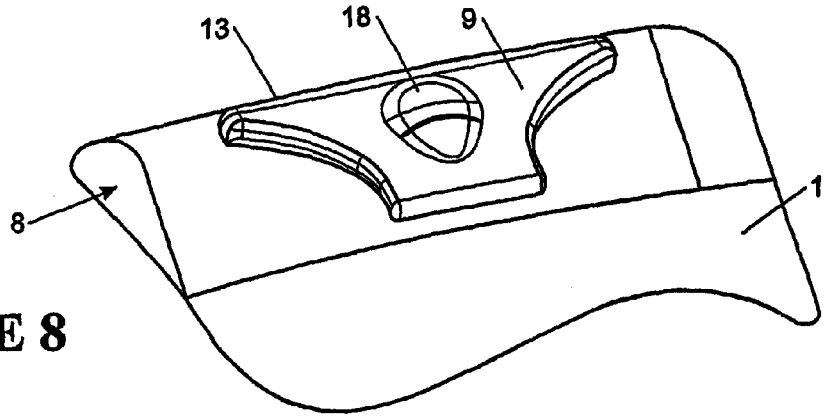
FIGURE 8

EDGE FITTINGS FOR SOFT-EDGED TRAMPOLINE

CROSS REFERENCE TO RELATED APPLICATION

This application is a continuation of U.S. application Ser. No. 12/406,572 filed Mar. 18, 2009 which is a continuation of U.S. application Ser. No. 10/496,178 which is the U.S. national stage of PCT/NZ02/00255, filed Nov. 20, 2002, the entireties of which are incorporated herein by reference.

FIELD OF INVENTION

The invention relates to a trampoline for sporting and/or recreational use which is soft-edged relative to conventional trampolines which support the mat of the trampoline via a solid peripheral frame and exposed springs between the frame and the mat.

BACKGROUND

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

SUMMARY OF THE INVENTION

The invention provides an improved or at least alternative form of such a soft-edged trampoline.

In broad terms in one aspect the invention comprises a trampoline including a flexible mat, a plurality of resiliently flexible rods each having a lower end retained in a frame of the trampoline and an enlarged upper end, and a plurality of fittings having a greater dimension approximately in the plane of the mat than in a direction through the mat, coupled to the mat about a periphery of the mat and including on or in an underside of each fitting a socket cavity which receives the enlarged upper end of a flexible rod, so that the upper ends of the flexible rods are pivotally connected to the periphery of the mat.

Preferably the fittings have an outer edge adjacent an outer edge of the mat, which outer edge of the fittings is wider approximately in the plane of the mat than an inner edge of the fittings. Typically the widest dimension of the fittings approximately in the plane of the mat is at an outer edge of the fittings closest to an outer edge of the mat. In one form the fittings have an approximate truncated triangular shape in plan view.

Preferably the fittings are positioned within a pocket or pockets in or adjacent to the peripheral edge of the mat. A part of the mat defining the pocket or pockets wraps around the outer edge of the fittings.

In broad terms in another aspect the invention comprises a trampoline including a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the enlarged upper end of a flexible rod so that the upper ends of the flexible rods are pivotally connected to the periphery of the mat, and wherein the fittings have a wide outer edge adjacent an outer edge of the mat which engages a pocket or pockets about or in the periphery of the mat.

In broad terms in a further aspect the invention comprises a trampoline including a flexible mat, a plurality of fittings coupled to the mat about a periphery of the mat, a plurality of resiliently flexible rods each having a lower end retained in a frame of the trampoline and an upper end connected to a said fitting, and or in an underside of each fitting a socket cavity which receives an enlarged upper end of the flexible rod connected to the fitting or a ball shaped portion which is received by a socket cavity on the end of the rod connected to the fitting, so that the upper ends of the flexible rods are pivotally connected to the periphery of the mat.

In the trampoline of the invention the coupling of the upper ends of the rods to the periphery of the mat via fittings having a cavity on the underside of the fittings and enlarged upper ends of the rods (or vice versa) provides a number of advantages. The end of the rod is enclosed so that it is much less likely to cause harm to a user falling On the edge of the trampoline. A more secure coupling between the ends of the rods and the mat, so that the rods remain more securely attached while the trampoline is in use, is achieved. And the connection allows easy assembly and disassembly of the rod-spring from the mat edge. Trampolines are generally freighted to the purchaser in disassembled form and it is essential that the purchaser can assemble the trampoline from the separate components without difficulty.

In this specification (including claims) the term "trampoline" is intended to extend to smaller trampolines commonly referred to as rebounders also, as well as larger trampolines of all sizes.

BRIEF DESCRIPTION OF THE DRAWINGS

Preferred forms of trampoline are described with reference to the accompanying drawings by way of example and without intending to be limiting, wherein:

FIG. 6 shows the fitting alone from below, FIG. 7 is an enlarged part cross-sectional view of the end part of a rod and a rod end, FIG. 8 shows a portion of the periphery of the mat of the trampoline, showing a single fitting in position within a pocket in the periphery of the mat.

DETAILED DESCRIPTION OF PREFERRED FORMS

Figure 1:
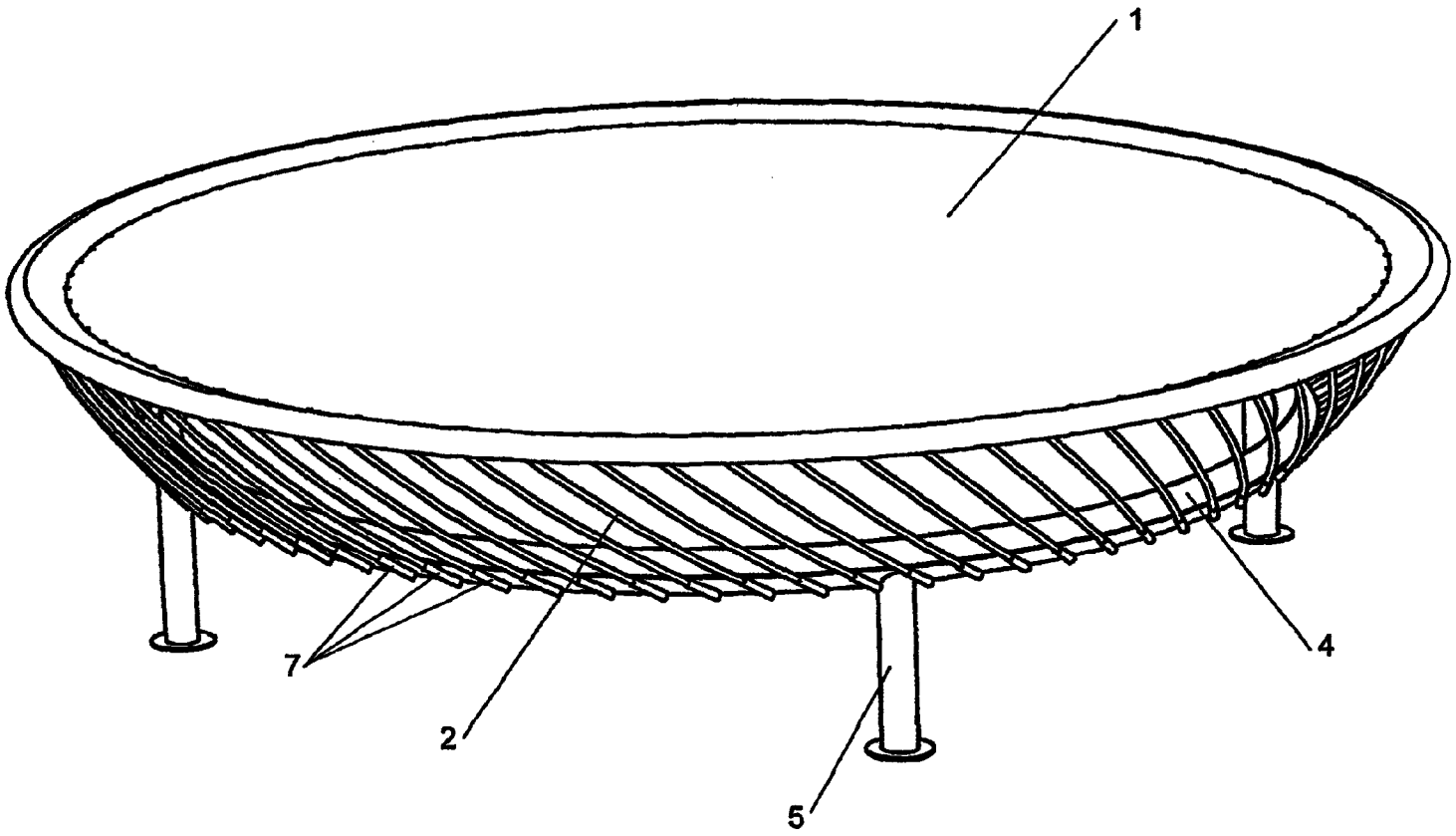
FIG. 1 is a perspective view of a preferred form trampoline.
Figure 2:
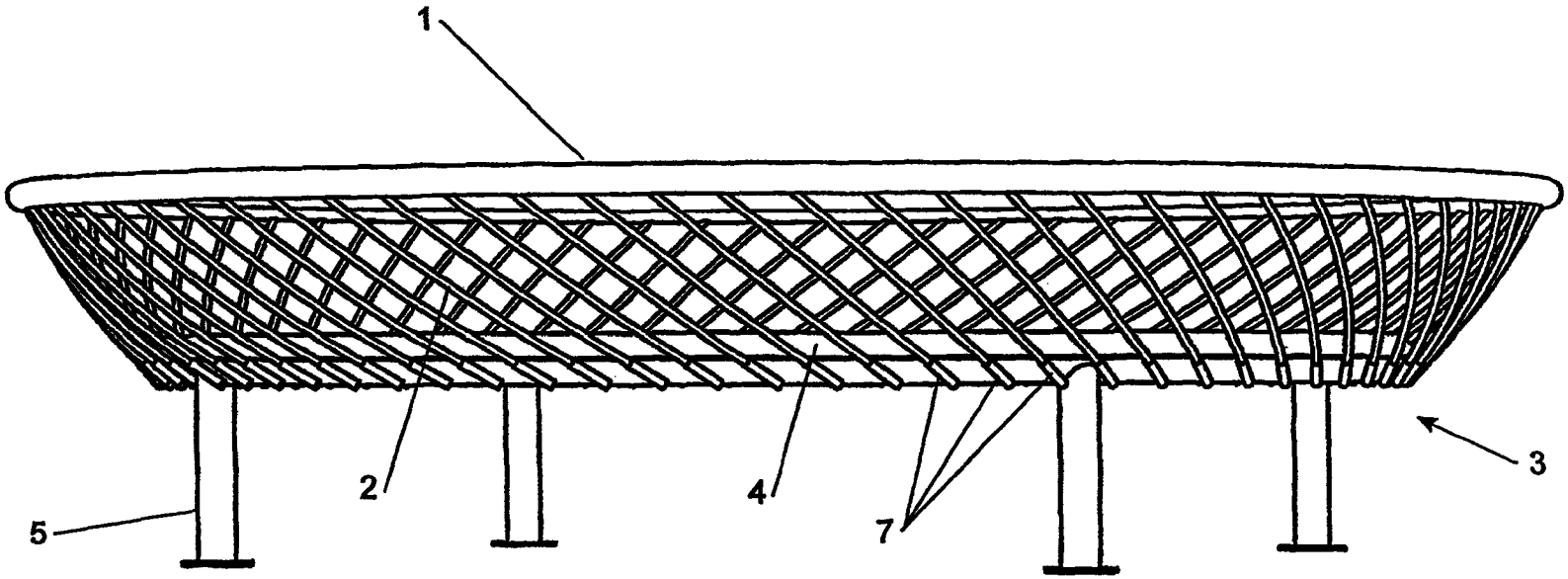
FIG. 2 is a side view of the trampoline of FIG. 1.
Figure 3:
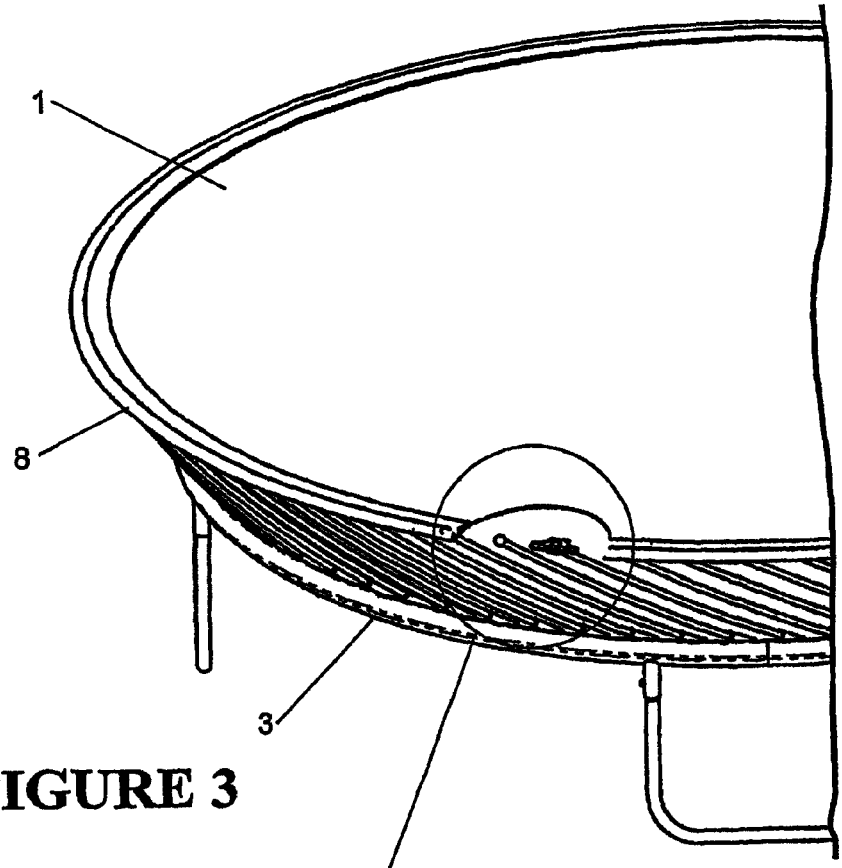
FIG. 3 is similar to FIG. 1 but of one side of the trampoline only and showing a portion of the edge of the mat of the trampoline cut away.

Referring to FIGS. 1 to 3, the preferred form trampoline comprises a flexible mat 1 on which users may bounce, a plurality of resiliently flexible rods 2, and a base frame 3.

The preferred form trampoline shown is circular in shape but the trampoline could be of any other desired shape such as oval, square, rectangular or similar.

The base frame of the preferred form trampoline comprises a circular beam 4 typically formed of steel or aluminium for example, which may be supported from the ground by legs 5.

The rods 2 are typically fibre glass rods but may alternatively be formed of spring steel for example. The lower ends of the rods are retained by the base frame 3 and the upper ends of the rods connect to fittings 6 as will be further described, which are coupled to the mat 1 about the periphery of the mat. In the preferred form the lower ends of the rods 2 enter into tubular holders 7 fixed to the circular beam as shown, but the lower ends of the rods may be coupled to the circular beam, or a base frame of the trampoline of any other form, in any suitable way.

In the preferred form the mat, which is typically heavy canvas or a woven synthetic material, is doubled back upon itself and fixed by stitching for example about the periphery of the mat to form a continuous pocket 8 extending about the periphery of the mat. A number of the fittings 6 are positioned within this pocket in the peripheral edge of the mat as shown in FIG. 3 in particular and also FIG. 8. The fittings may be loosely captured within the pocket or alternatively may be stitched to the mat within the edge pocket, or mechanically fastened to the mat via rivets for example.

The rods have enlarged upper ends which connect to the fittings 6. FIGS. 4 to 8 show a fitting and the connection of a rod end to the fitting in more detail. Preferably the fittings have a generally planar body portion 9, and a socket cavity 10 is defined on or in an underside of the body portion 9 of the fitting. The body 9 of the fitting of the fitting has a greater dimension approximately in the plane of the mat than in a direction through the mat. Typically the fittings will be formed from a plastics material, by injection moulding for example. In the preferred form portion 11 extends downwardly from the underside of the fitting to define the socket cavity 10. The enlarged rod end fits 12 into the socket cavity 10, as shown into FIG. 6 in particular. The fitting may optionally include a slight dome 18 on body of the fitting over the socket cavity 10.

Also in the preferred form the fittings have an outer edge 13 which in use is closest to the outer peripheral edge of the mat, which edge 13 is wider in the plane of the mat than an inner edge of the fittings. The particular fitting 6 shown has an approximate truncated triangular shape in plan view, with concave sides, but this is non-limiting and in other forms the fitting could be alternatively shaped.

Figure 3A:
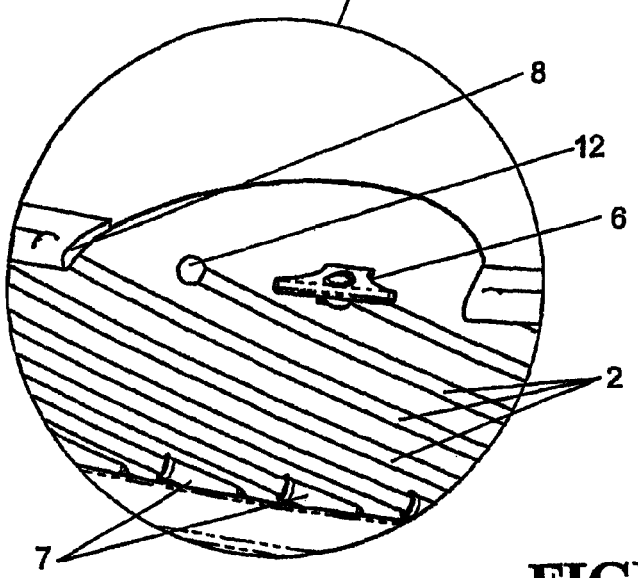
FIG. 3*a* is an enlarged view of the cut away edge portion of the trampoline.
Figure 4:
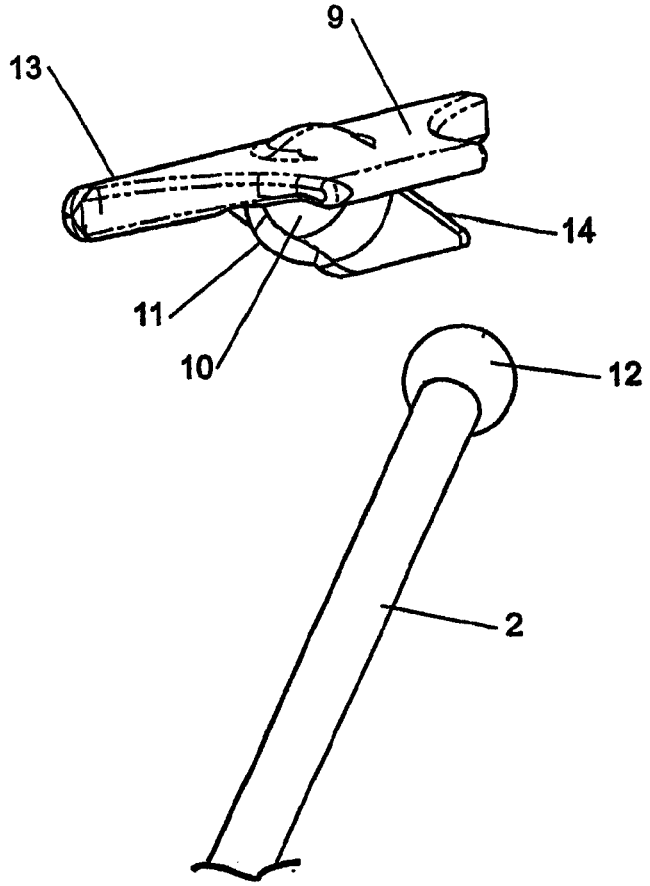
FIG. 4 shows an individual fitting and rod end separate from the other components of the trampoline.
Figure 5:
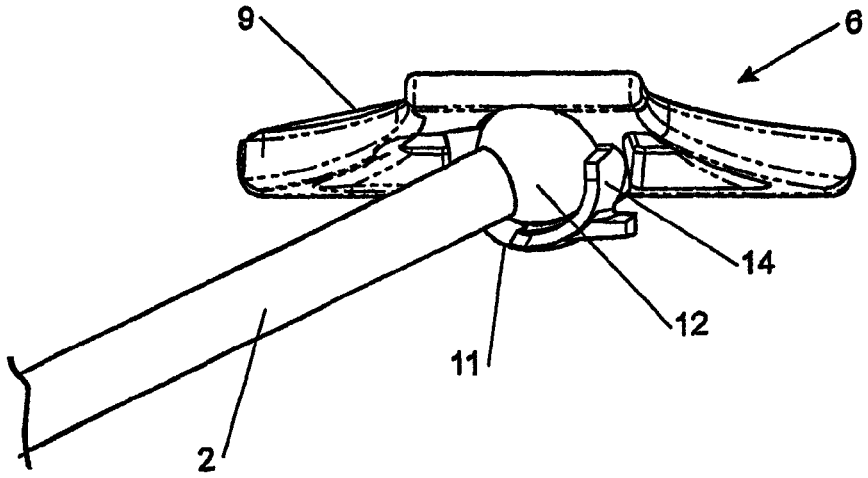
FIG. 5 shows the fitting and rod end connected together, from below.

In the preferred form the part of the mat which is doubled back to define the pocket 8 in the peripheral edge of the mat wraps around the outer edges 13 of the fittings 6, as shown in FIGS. 3 and 3A so that in use the outer edges of the fittings contact the inside surface of the pocket at its outer edge as shown, which assists in transferring forces between the fitting and the mat or vice versa. This may not be essential however, and in an alternative form individual pockets may be formed adjacent but spaced from the outer most peripheral edge of the mat, and defined by stitching through the mat to form the pockets which each receive and retain a fitting. Alternatively again the fittings may instead of being received in a pocket or pockets in the outer edge of the mat, be stitched directly to the mat adjacent its outer edge, or mechanically fastened to the mat.

In use as the trampoline is bounced on by a user, this will cause pivotal movement between the upper ends 12 of the rods 2 and the fittings 6 coupled to the mat, to a greater or lesser extent depending upon the size and energy of the user. If the user bounces close to a part of the edge of the mat, significant movement of the ball ends 12 of the few rods closest to the point where the user bounces will pivot significantly within the socket cavities 10 in the fittings. A relatively secure and safe coupling of the upper ends of the rods to the mat is provided, without adversely affecting the performance of the trampoline is use. In addition the ends of the flexible rods are enclosed to increase protection to a user falling on the edge of the trampoline. At the same time assembly and disassembly of the trampoline and in particular connection between the individual rods and the mat can be carried out with relative ease. Typically the trampoline will be delivered to a purchaser in disassembled form. The purchaser need only insert the lower ends of the rods into the trampoline base, loosely place the mat over the trampoline base, and then bend each resilient rod as required to engage the ball ends 12 of the rod into the socket cavities of the fittings 6. The rod ends can enter the fittings from the side.

In the preferred form the portion 10 of the fitting on the underside of the body 9 of the fitting which defines the socket cavity includes a part 14 which extends inwardly towards the centre of the trampoline to ensure the fitting slides over the rod below in the event of a heavy bounce on the adjacent trampoline edge. This inward extension prevents the fitting from catching on the rod below and forcing the lower rod loose from its fitting.

FIG. 8 shows a preferred connection between a fibreglass rod 2 and a separately formed ball shaped upper end part 12, which is typically injection moulded from a plastics material. An annular groove 15 is formed around the rod end as shown. A cavity is formed in the ball end part 12 which enables the end part 12 to be fitted to the rod end. The ball end part 12 includes an annular protrusion 16, which when the ball part is fitted to the rod end will snap fit into the annular groove 15. Alternatively the plastic ball part 12 may snap fit over an annular protrusion or protrusions around the rod end. Any suitable mechanical arrangement may be employed. Alternatively separately formed ball parts 12 may be bonded to the rod ends. The plastic ball parts 12 may optionally have a flattened end surface 19 which assists in stabilising the ball parts if they are placed upside down on a surface during insertion of the rods 2 during assembly of a trampoline.

Figure 9:
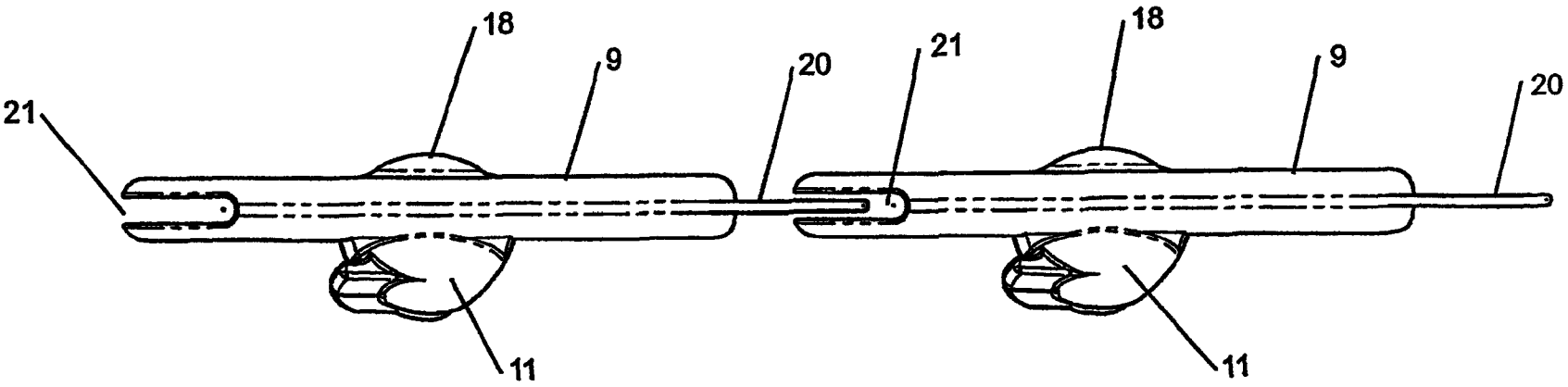
FIG. 9 shows an alternative arrangement where the fittings around the periphery of the trampoline are coupled together by a flexible tongue and recess connection between adjacent fittings.

FIG. 9 shows an alternative form where the fittings 6 are coupled together. The fittings 6 are generally similar to those described previously but each include an integrally moulded flexible plastic tongue 20 on one side and corresponding recess on the other side, so that the flexible tongue 20 of one fitting engages into the recess 21 in the adjacent fitting in the assembled trampoline. The depth of the recess 21 is sufficient to allow movement of the tongue into and from the recess as a user bounces on the trampoline and during use the tongue 20 will flex, particularly when a user bounces near the edge of the trampoline. In a yet further alternative form, the adjacent fittings 6 may slidingly overlap with one another.

In the preferred forms described above a ball shaped end part on the rods 2 is received in a socket cavity of the fittings 6. In an alternative form the upper end of each rod may provide a socket cavity in which is received a ball shaped portion moulded on the underside of the fittings 6. The socket cavity on the upper end of the rod may be defined by an injection moulded plastic part fitted to the end of the rod.

The foregoing describes the invention including preferred forms thereof Alterations and modifications as will be obvious to those skilled in the art are intended to be incorporated within the scope hereof as defined in the accompanying claims.

What is claimed is:

1. A trampoline comprising:

a flexible mat, the periphery of the mat is in a single, common plane, a plurality of upwardly extending, elongate resilient flexible elements each having a lower end retained in a frame of the trampoline and an upper end, and a plurality of fittings coupled to the mat about the periphery of the mat and to an underside of each of which fittings the upper end of a said flexible element is pivotally connected, the resilient flexible elements arranged to bend laterally when supporting a user bouncing on the mat.

2. A trampoline according to claim 1 wherein the plurality of fittings are positioned within a pocket or pockets defined by the mat, wherein a part of the mat defining the pocket or pockets wraps around the outer edge of the fittings.

3. A trampoline according to claim 1 wherein a part of each fitting depends downwardly from the underside of the fitting to define a socket cavity in or on the underside of the fitting which receives the upper end of a flexible element.

4. A trampoline according to claim 3 wherein the part of the fitting which depends downwardly from the underside of the fitting to define the socket cavity includes a portion which extends towards the centre of the trampoline and shaped to further assist in preventing an enlarged upper end of the received flexible element from dislodging from the fitting during use of the trampoline.

5. A trampoline according to claim 4 wherein the fittings are one piece fittings formed from a plastics material.

6. A trampoline according to claim 1 wherein said upper end is approximately ball shaped.

7. A trampoline according to claim 1 wherein said resilient flexible elements additionally extend laterally outwardly from the frame.

8. A trampoline according to claim 1 wherein the plurality of fittings are spaced apart around the entire periphery of the mat.

9. A trampoline according to claim 1 wherein the flexible elements comprise fiber glass.

10. A trampoline according to claim 1 wherein the flexible elements comprise steel.

11. A trampoline according to claim 1 wherein the flexible elements are substantially straight rods.

12. A trampoline according to claim 1 wherein the flexible mat resides entirely above the flexible elements.

13. A trampoline comprising:

a flexible mat, a plurality of upwardly extending, elongate resilient flexible elements each having a lower end retained in a frame of the trampoline and an upper end, and a plurality of fittings each positioned within a pocket in or adjacent the peripheral edge of the mat, coupled to the mat about a periphery of the mat and including on or in an underside of each fitting a socket cavity which receives the upper end of a said flexible element, so that the upper end of the flexible element is pivotally connected to the fitting, the flexible elements arranged to bend laterally when supporting a user bouncing on the mat.

14. A trampoline according to claim 13 wherein a part of the mat defines the pocket or pockets and wraps around the outer edge of the fittings.

15. A trampoline according to claim 13 wherein a part of the each fitting which defines the socket cavity in or on the underside of the fitting, which receives the upper end of a flexible element, depends downwardly from the underside of the fitting.

16. A trampoline according to claim 15 wherein the part of the fitting which depends downwardly from the underside of the fitting to define the socket cavity includes a portion which extends towards the centre of the trampoline and shaped to further assist in preventing an enlarged upper end of the received flexible element from dislodging from the fitting during use of the trampoline.

17. A trampoline according to claim 16 wherein the fittings are one piece fittings formed from a plastics material.

18. A trampoline according to claim 13 wherein said upper end is approximately ball shaped.

19. A trampoline according to claim 13 wherein said resilient flexible elements additionally extend laterally outwardly from the frame.

20. A trampoline according to claim 13 wherein the plurality of fittings are spaced apart around the entire periphery of the mat.

21. A trampoline according to claim 13 wherein the flexible elements are substantially straight rods.

* * * * *